US008494106B2

(12) United States Patent
Wazybok et al.

(10) Patent No.: US 8,494,106 B2
(45) Date of Patent: Jul. 23, 2013

(54) SHIPPING CONTAINER FOR SHIPPING CHANNELED FUEL BUNDLES

(75) Inventors: David Francis Wazybok, Castle Hayne, NC (US); David Grey Smith, Leland, NC (US); Andrew Langston, Wilmington, NC (US); William Williams, Wilmington, NC (US); James Michael Downs, Wilmington, NC (US); Christopher R. Jones, Wilmington, NC (US)

(73) Assignee: Global Nuclear Fuel—Americas, LLC, Wilmington, NC (US)

( * ) Notice: Subject to any disclaimer, the term of this patent is extended or adjusted under 35 U.S.C. 154(b) by 1254 days.

(21) Appl. No.: 11/940,434

(22) Filed: Nov. 15, 2007

(65) Prior Publication Data

US 2009/0129529 A1 May 21, 2009

(51) Int. Cl.
*G21F 5/012* (2006.01)

(52) U.S. Cl.
USPC ..... 376/272

(58) Field of Classification Search
USPC ..... 376/272; 250/506.1, 507.1
See application file for complete search history.

(56) References Cited

U.S. PATENT DOCUMENTS

| | | | | | |
|---|---|---|---|---|---|
| 4,780,268 | A * | 10/1988 | Papai et al. | ..... | 376/272 |
| 5,251,244 | A * | 10/1993 | Wazybok et al. | ..... | 376/261 |
| 5,263,064 | A * | 11/1993 | Sappey | ..... | 376/261 |
| 5,285,485 | A * | 2/1994 | Rosenbaum et al. | ..... | 376/261 |
| 5,894,134 | A * | 4/1999 | Kissinger | ..... | 250/506.1 |
| 6,108,392 | A * | 8/2000 | Yoshizawa et al. | ..... | 376/272 |
| 6,401,887 | B1 * | 6/2002 | Hur | ..... | 188/376 |
| 2002/0067791 | A1 * | 6/2002 | Peters et al. | ..... | 376/272 |

* cited by examiner

*Primary Examiner* — Jack W Keith
*Assistant Examiner* — Sean P Burke
(74) *Attorney, Agent, or Firm* — Nixon & Vanderhye P.C.

(57) ABSTRACT

A shipping container is constructed for shipping channeled fuel bundle assemblies. The shipping container includes an outer container, an inner container sized to fit within the outer container, and shock absorbing material disposed at least between the outer and inner containers. The inner container is shaped to house at least one pre-channeled fuel bundle assembly including a channel, a channel fastener, and an array of fuel rods supported by grid spacers between an upper tie plate and a lower tie plate. The inner container includes a lower tie plate restraint device shaped to receive the lower tie plate and a lower portion of the channel, and an upper tie plate restraint device shaped to receive the upper tie plate and an upper portion of the channel and channel fastener assembly. The lower and upper tie plate restraint devices are lockable within the inner shipping container.

11 Claims, 11 Drawing Sheets

SHIPPING CONTAINER FOR SHIPPING CHANNELED FUEL BUNDLES

BACKGROUND OF THE INVENTION

The invention relates generally to channeled fuel bundles for a nuclear reactor and, more particularly, to a shipping container enabling the shipment of a nuclear fuel bundle in a pre-channeled condition.

With reference to FIGS. 1 and 2, a typical fuel assembly in a light water boiling nuclear reactor vessel includes a lower tie plate 1, an upper tie plate 2 and a matrix of sealed fuel rods 3 supported between the upper and lower tie plates between fuel rod expansion springs 4 and finger springs 5 as shown. Spacers 12 serve to support the fuel rods 3 against lateral movement. The fuel rods 3 contain nuclear fuel pellets 6 in sealed containment for supporting a required critical reaction for the generation of steam. One or more coolant water rods 7 is included in the matrix of the fuel rods 3 and is also supported between the upper 2 and lower 1 tie plates. A channel 8 surrounds the tie plates, fuel rods and coolant water rods, and is secured via a channel fastener assembly 9 to the top of the fuel assembly via a compression channel fastener spring 14. In some cases the channel 8 may also be secured to both the lower tie plate 1 and the upper tie plate 2 within the same fuel assembly. The channel 8 is commonly square in cross-section and is made of metal (preferably an alloy called Zircaloy). A bail handle 10 is integrated within the upper tie plate 2 as part of the assembly for transporting and moving the fuel assembly.

In use, water passes from the bottom of the channeled fuel assembly to the top of the fuel assembly. Water enters through the lower tie plate 1 within the channel 8 and passes between the vertically standing fuel rods 3. Heated water and generated steam exit from within the channel 8 between the spacers 12 and fuel rods 3 and out through the upper tie plate 2. The channel 8 confines the required moderator coolant flow to a flow path that is restricted between the tie plates 1, 2.

The lower tie plate 1 and the upper tie plate 2 serve to support the sealed fuel rods 3 in the vertical and standing matrix. Typically, the upper tie plate 2 forms an overlying matrix of fuel rod support points, such as tie rods. Eight of these support points are conventionally placed corresponding with male threaded tie rods 11. The tie rods 11, which contain fuel pellets 6 similar to the fuel rods 3, are threaded at their lower and upper ends for corresponding attachment to the lower tie plate 1 and the upper tie plate 2. The lower tie plate 1 similarly forms an underlying matrix of fuel rod support points. These underlying support points correspond for the most part to the overlying support points of the upper tie plate 2. Conventionally, about eight of these support points are threaded with female apertures, which correspond to the overlying apertures in the upper tie plates 2. Into these threaded support points in the lower tie plates 1 are placed the lower threaded ends of the fuel tie rods 11. Thus, conventionally, the two tie plates 1, 2 are tied together with the fuel tie rods 11, by their threaded end plugs.

Currently, the fuel bundle, channel, and channel fastener are shipped to the customer site separately in different shipments. To ship the fuel bundles from the factory to the customers requires significant preparation including plastic inserts as support for each fuel rod, plastic sleeving to prevent foreign material from entering the length of the bundle, and protective netting to prevent debris from entering from the top or bottom of the fuel bundle. Two fuel bundles are typically loaded into a single NRC certified shipping package without channels.

Channels and channel fasteners are manufactured and shipped from a separate facility than the fuel bundle. The channels are currently packed and shipped to customers in custom single-use disposable shipping containers.

Once received at the customer site, the fuel is unloaded from the shipping packages one bundle at a time. The plastic inserts and protective netting are removed and placed back into the shipping package, and the materials are sent back to the fuel manufacturing facility for disposal.

The channels are received at the customer site and are removed from their single shipping container. Once removed from the shipping container, the protective vacuum-sealed sleeving is removed from each channel, prior to assembly. The channel container and their sleeving materials are then disposed of by the customer. The channel fasteners are shipped to the customer site in a separate container, and packing materials are disposed of separately.

Once each component has been independently inspected, the fuel bundle, channel, and channel fastener are assembled on site. To install the channel onto the fuel bundle, the channel must be oriented in the proper position and raised above the upper tie-plate and slowly lowered over each of the grid spacers until the channel engages the lower tie-plate. Depending on the fuel bundle design, the channel may interface with the finger springs attached to the lower tie-plate.

It would be desirable to provide a shipping container that would enable a fuel bundle to be shipped from the factory as a fully assembled channeled fuel bundle that is ready for placement within the reactor core vessel.

BRIEF DESCRIPTION OF THE INVENTION

In an exemplary embodiment, a shipping container is constructed for shipping channeled fuel bundle assemblies. The shipping container includes an outer container, an inner container sized to fit within the outer container, and shock absorbing materials disposed at least between the outer and inner containers. The inner container is shaped to house at least one pre-channeled fuel bundle including a channel, a channel fastener, and an array of rods supported by grid spacers between an upper tie plate and a lower tie plate. The inner container includes a lower tie plate restraint device shaped to receive the lower tie plate and a lower portion of the channel, and an upper tie plate restraint device shaped to receive the upper tie plate and an upper portion of the channel. The lower and upper tie plate restraint devices are lockable into the inner container.

In another exemplary embodiment, the inner container includes a space shaped to house at least one pre-channeled fuel bundle including a channel, a channel fastener, and an array of rods supported by grid spacers between an upper tie plate and a lower tie plate. The inner container includes a pair of restraint devices shaped to receive the lower tie plate and the upper tie plate, respectively, in one orientation, and a hold down bar selectively lockable across the space. The hold down bar, which may contain a shock absorbing material, secures the channeled fuel bundle within the inner container.

DETAILED DESCRIPTION OF THE INVENTION

Figure 3:
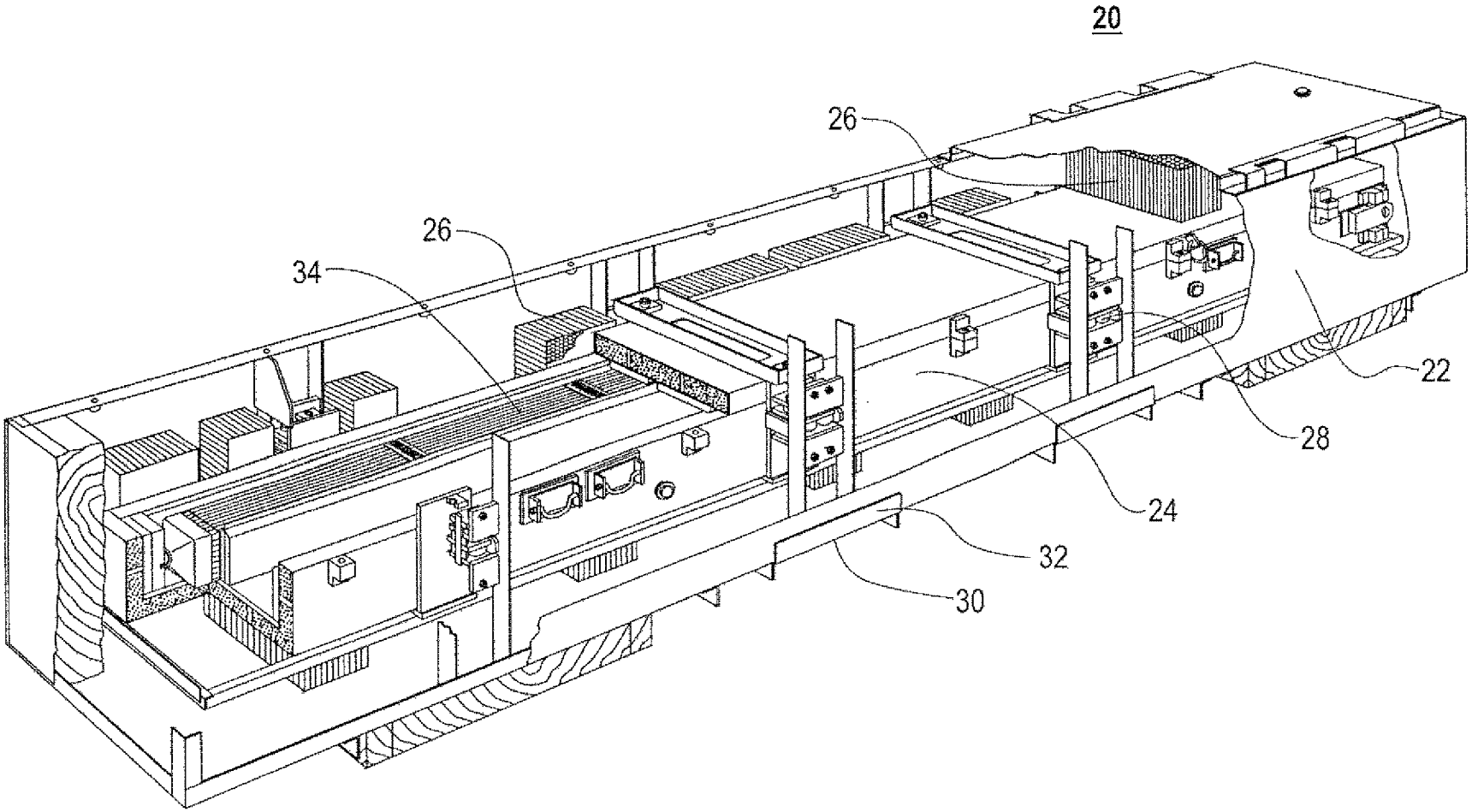
FIG. 3 is a cutaway illustration of a fully assembled shipping container for shipping the channeled fuel assemblies.

FIG. 3 is a cutaway view of a shipping container 20 suitable for shipping channeled fuel bundles. The shipping container 20 includes an outer container 22 preferably formed of steel such as stainless steel or higher strength materials. An inner container 24 is sized to fit within the outer container 22. A shock absorbing material 26 is preferably placed at least between the outer 22 and inner 24 containers at various interval locations. Additionally, mechanical vibration proof devices 28 are disposed between the outer container 22 and inner container 24. As shown in FIG. 3, the outer container 22 is also provided with a forklift pocket 30 for facilitating transport via a forklift and a rubber bumper 32 for preventing damage to the outer container 22 by a forklift or any other lifting device.

Figure 4:
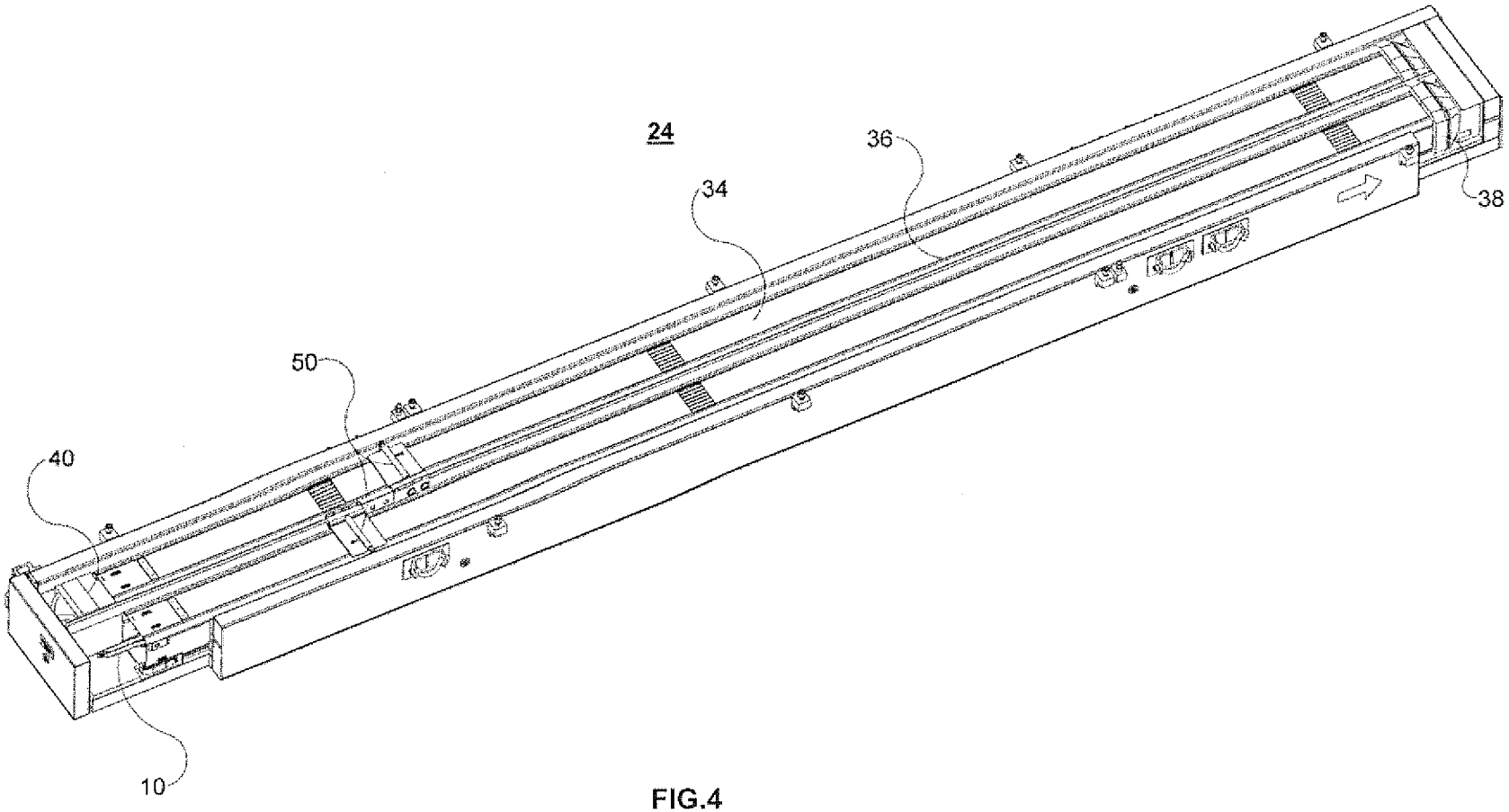
FIG. 4 is a fully assembled inner shipping container without its lid, containing two nuclear fuel assemblies as packaged prior to shipment.

FIG. 4 is a perspective view of the inner container 24. The inner container 24 is shaped to house at least one pre-channeled fuel bundle 34, which includes a channel, a channel fastener, and an array of fuel rods and grid spacers that are supported between the upper tie-plate and the lower tie-plate. As shown in FIG. 4, in a preferred construction, the inner container 24 is divided into separate spaces for receiving respective channeled fuel bundle assemblies 34 by a borated center rib 36. The borated center rib 36 is preferably constructed of an aluminum metal matrix that mitigates neutrons during normal and accident transport conditions. The inner container 24 also includes a lower tie-plate restraint device 38 and an upper tie-plate restraint device 40. Hold down bars 50 (described below) are shown as a restraining device for securing the one or more fuel assemblies within the inner shipping container 24.

Figure 5:
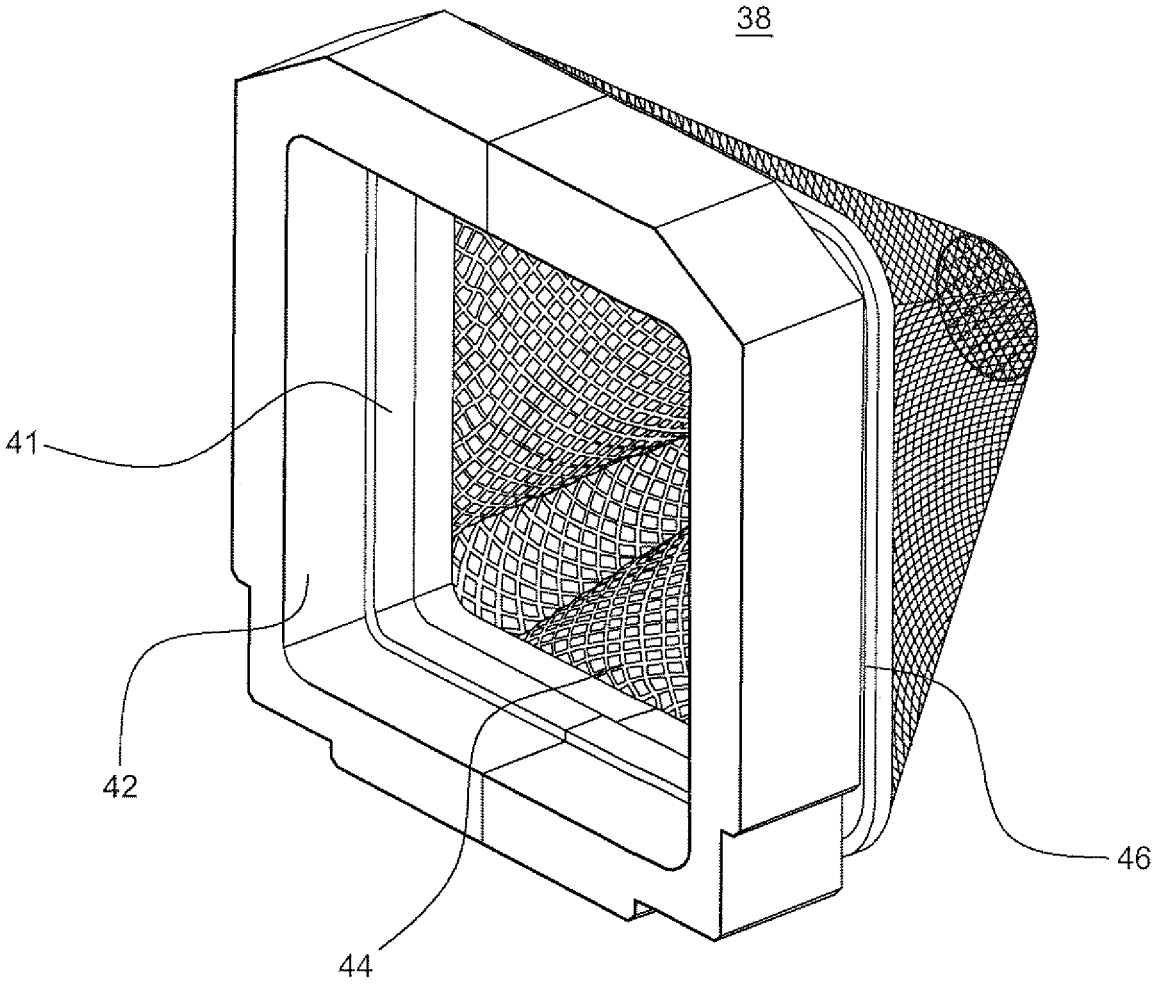
FIG. 5 shows the fully assembled lower tie-plate restraint device for securing the lower portion of the fuel assembly within the inner shipping container.
Figure 6:
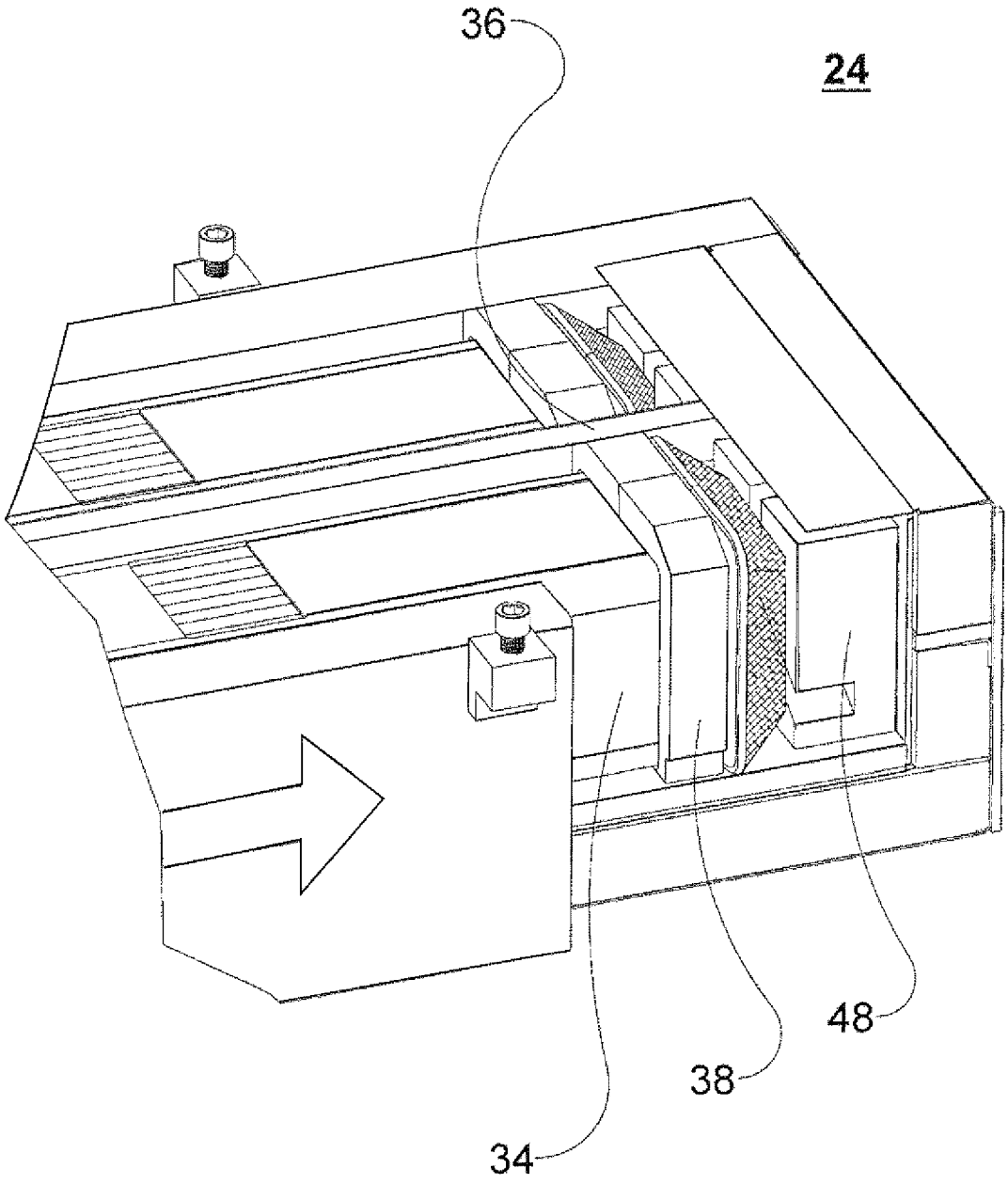
FIG. 6 illustrates the restraining device placed over the lower portions of the channel and the lower tie plate and then secured within the inner container.

The lower tie-plate restraining device 38 is shown in detail in FIGS. 5 and 6. As shown, the device 38 is shaped to receive the lower tie-plate and a lower portion of the fuel channel 8 that covers the fuel bundle. The lower tie-plate restraining device 38 is designed to be lockable within the inner container 24.

Preferably, the lower tie-plate restraint device 38 is composed of a high-density poly material that resists deformation, is shock absorbing, and is non-corrosive with the fuel bundle assembly 34 and shipping package materials of construction. As shown, the lower tie-plate restraining device 38 is designed to fit both the lower tie-plate and a lower portion of the channel within a tight tolerance that prevents independent movement of each component and fits tightly within the shipping package. The device 38 is formed such that it fits with the channeled bundle 34 in only one correct orientation and can be inserted into the shipping package in only one direction. The device 38 is machined to lock into the base of the inner container 24 utilizing a Y-block 48 and slots cut into the foam packing material of the inner container body and lid. The lower tie-plate restraining device 38 functions to maintain the center spacing of the channel to the lower tie-plate. A lower tie-plate restraining surface 41 receives the lower tie-plate, and a channel restraining surface 42 receives the lower portion of the channel.

The device 38 also integrates a replaceable protective netting 44 via a netting mounting groove 46 that prevents foreign material from entering the channeled fuel assembly 34 at its lower portion. The device 38 may be either a one-piece or multiple piece unit that can be easily installed prior to loading the channeled fuel assembly 34 into the inner shipping container. The lower tie-plate restraint device 38 may be constructed to be large enough to include the lower tie-plate Y-block 48, which is an interlocking, replaceable device at the lower end of the inner shipping container. The Y-block 48 is restrained by the inner container and is formed such that it fits within the end of the inner shipping container 24 in only one correct orientation and allows the lower tie plate restraint device 38 to be inserted into the shipping container in only one direction.

Figure 7:
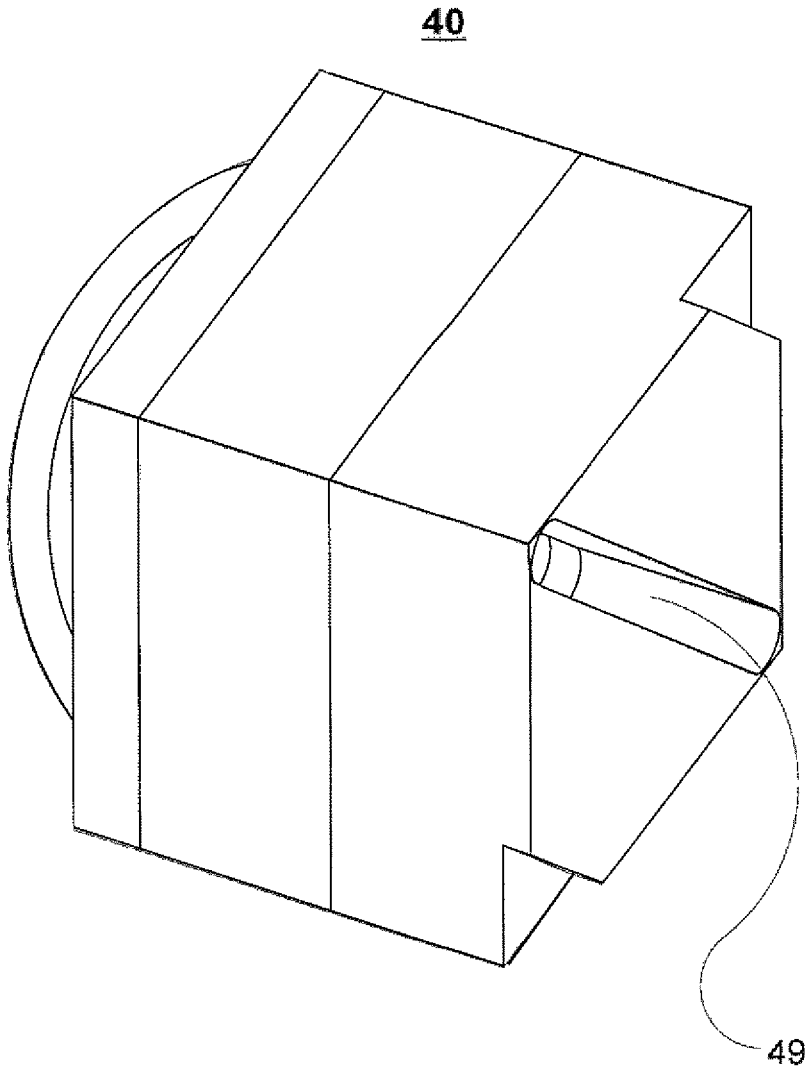
FIG. 7 shows the upper tie-plate restraint device for securing the upper portion of the fuel assembly within the inner shipping container.
Figure 8:
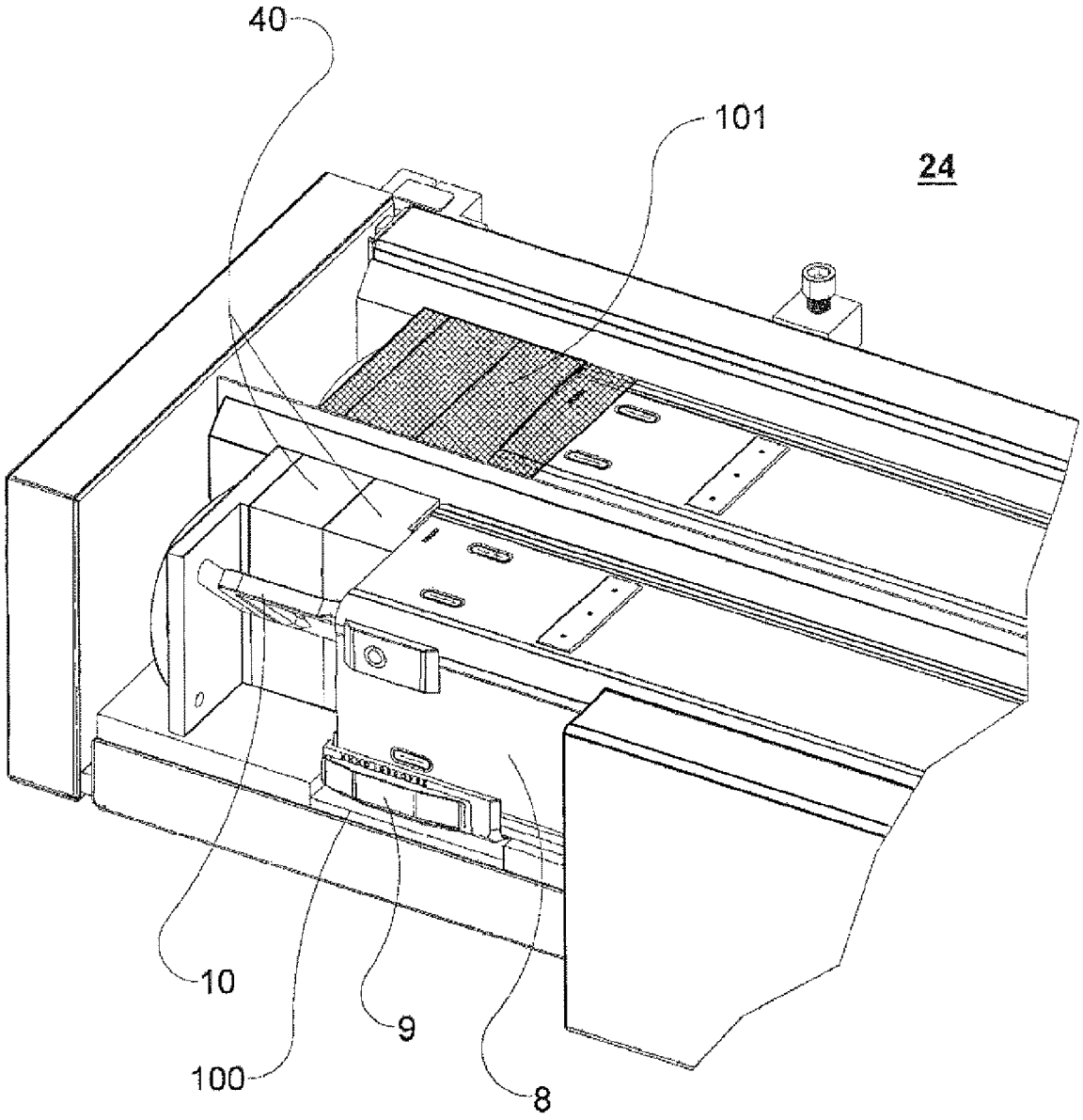
FIG. 8 is a cut-away illustration of the restraining device placed over the upper portions of the channel and upper tie plate secured within the inner container.

The upper tie-plate restraint device 40 is shown in FIGS. 7 and 8. The device 40 is shaped to receive the upper tie-plate bail handle. A netting material is used to keep debris out of the upper portion of the fuel assembly. In another embodiment, the device 40 is shaped to receive all of the upper tie-plate 2, an upper portion of the channel 8, and portions of the channel fastener assembly 9, thereby eliminating the need for a replaceable protective netting for keeping out debris materials. Both of the upper tie plate restraint devices 40 are formed such that they fit within the inner shipping container 24 in only one correct orientation. The upper tie plate restraint device 40 preferably must align correctly with the lower tie plate restraint device 38 and Y-block 48 prior to being inserted into the inner shipping container 24 in order for it to fit properly within the inner shipping container 24, thereby allowing it to be secured and lockable within the container. Preferably, the upper tie-plate restraint device 40 is composed of a high-density poly, plastic, wood or foam material that is shock absorbing and is non-corrosive with the fuel bundle assembly 34 and the shipping package materials of construction. The upper tie-plate restraint device 40 is designed to fit and secure the upper tie-plate 2, channel fastener 9, and the upper portion of the channel 8 within a tight tolerance that prevents independent movement and rotation of the channeled fuel bundle assembly 34 and fits tightly with the shipping package. The device 40 is formed such that it fits with the channeled bundle 34 in one correct direction and can only be inserted into the shipping package container in only one correctly aligned direction when aligned with the lower tie plate restraint device 40. The device 40 is machined to lock into the top end of the inner container 24 by several cut-outs 100 in the packaging material within the inner shipping container 24.

The device also integrates a replaceable protective netting 101 that prevents foreign material from entering the bundle from the top of the channeled fuel assembly 34.

Figure 1:
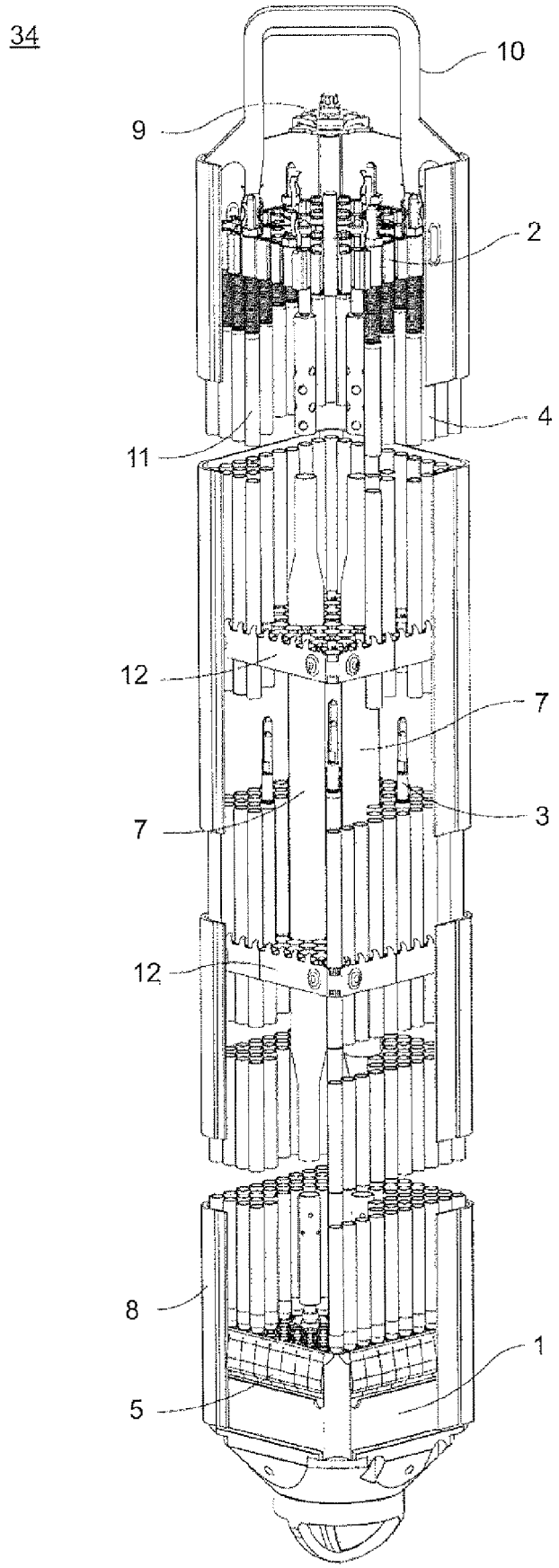
FIG. 1 illustrates an exemplary channeled fuel assembly for a light water boiling reactor.
Figure 2:
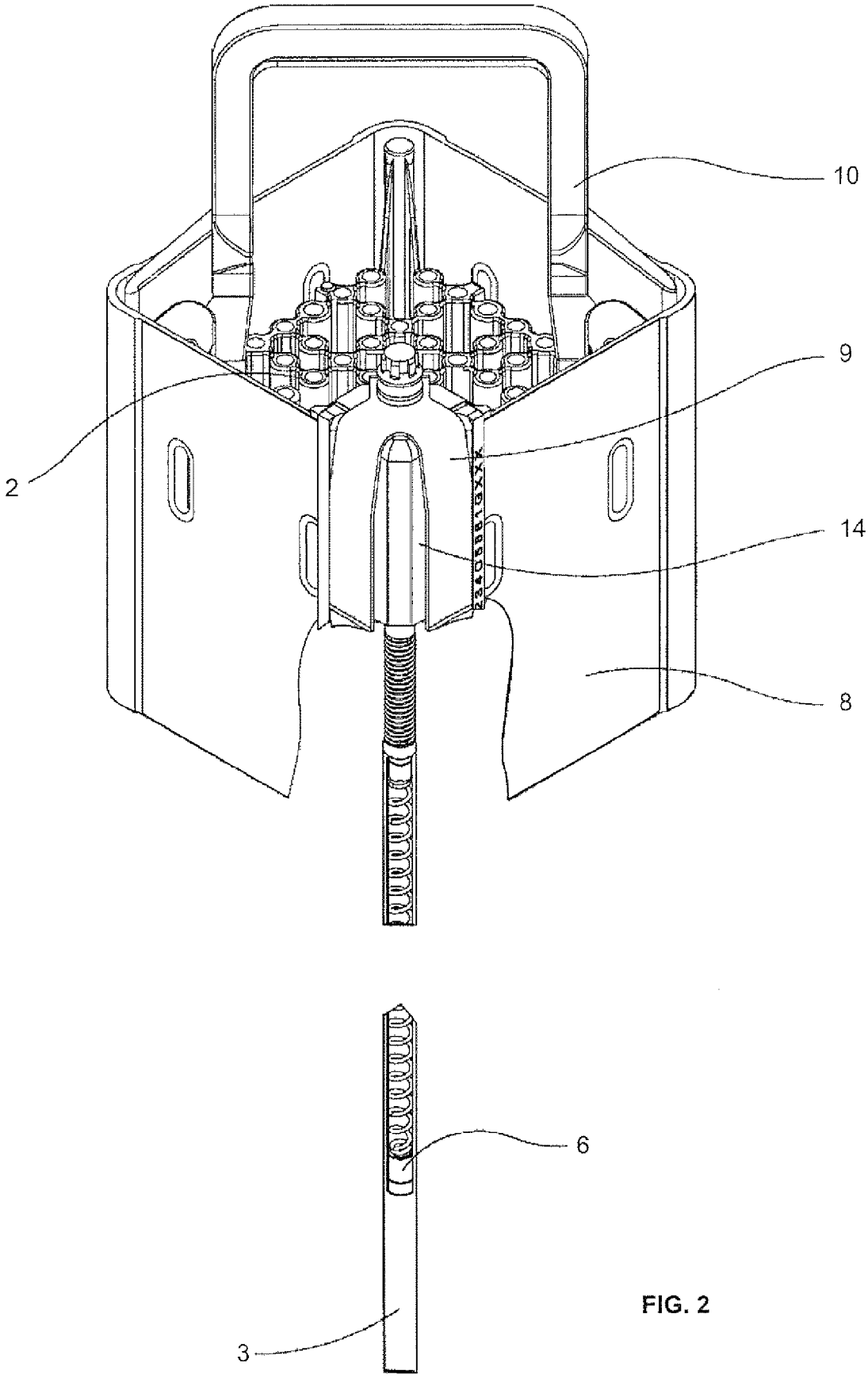
FIG. 2 illustrates an enlarged upper portion of the channeled fuel assembly as shown in FIG. 1.

The device 40 is either a one-piece or multiple piece unit that can be easily installed during the packaging process. The upper tie-plate restraint device 40 may be large enough to accommodate the upper tie-plate bail handle 10, which is used for lifting the bundle from the shipping container, via a bail handle slot 49, the upper tie-plate grid 2, the channel fastener assembly 9 and the channel 8. The device 40 may also include a window to view the serial number that may be located on the upper tie-plate bail handle 10 (see FIGS. 1 and 2).

Figure 9:
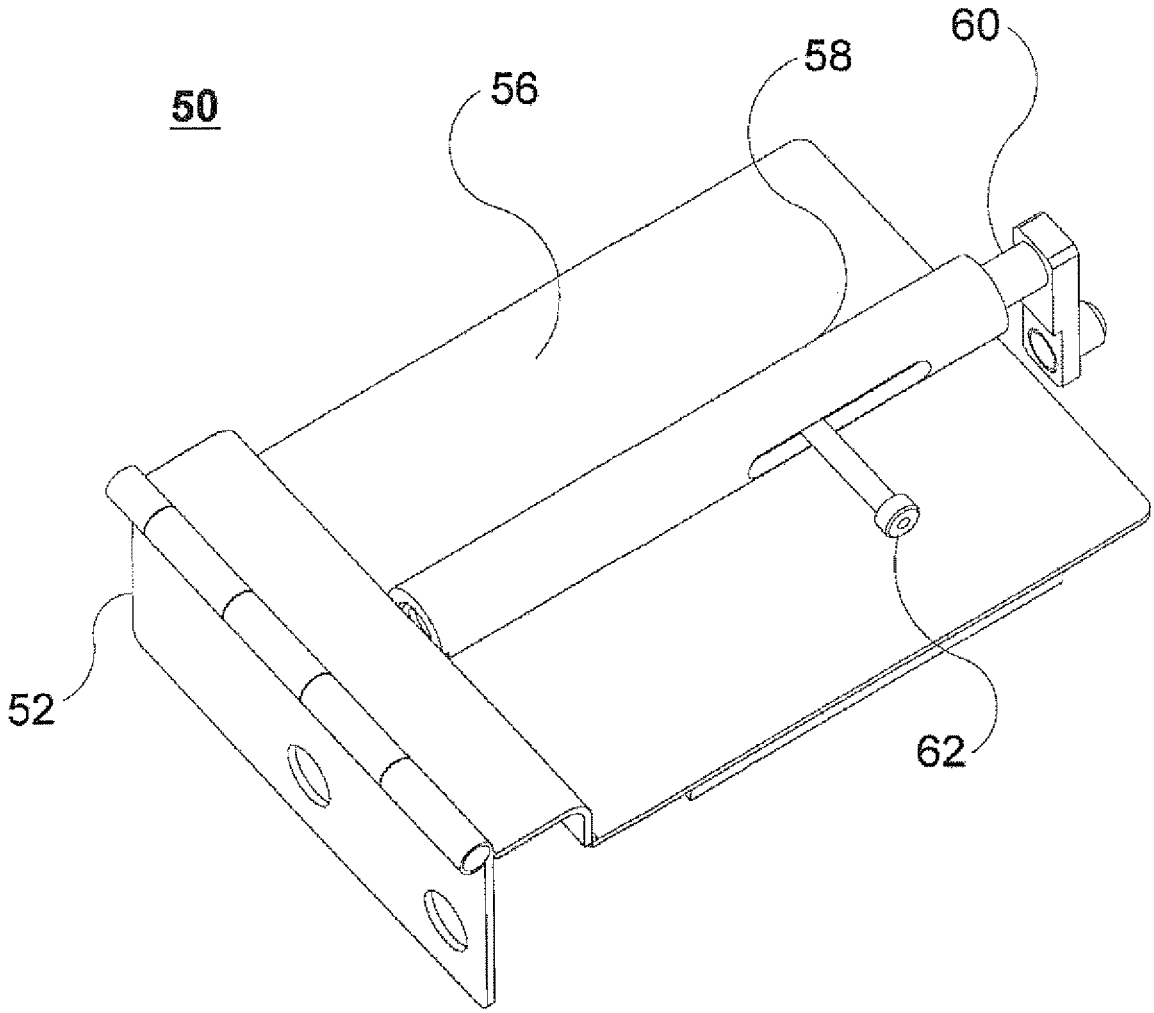
FIG. 9 is a top view of an integrated hold down bar for securing the channeled fuel bundle within the inner shipping container and some of its components.
Figure 10:
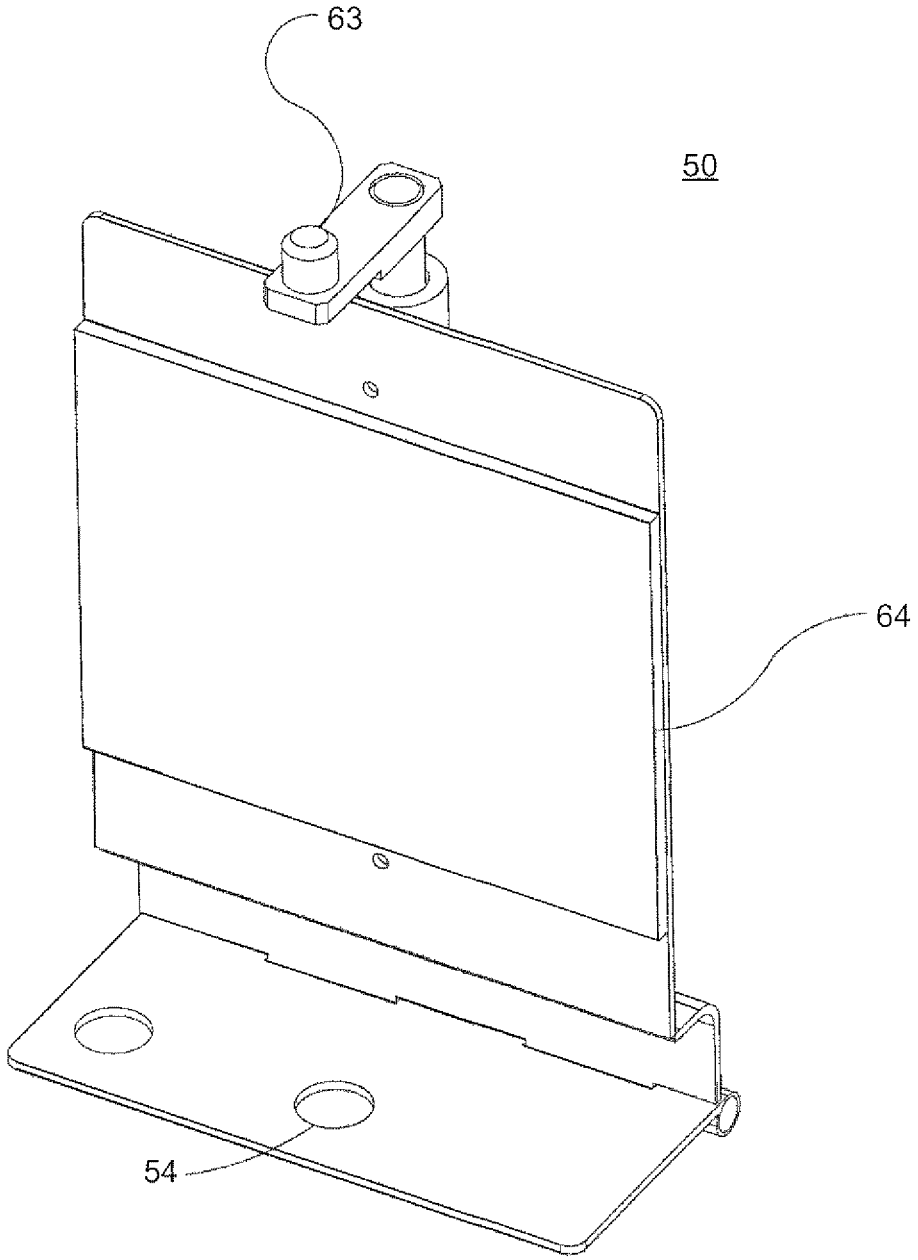
FIG. 10 shows the bottom side of the hold down bar and a shock absorbing material attached to its underside.
Figure 11:
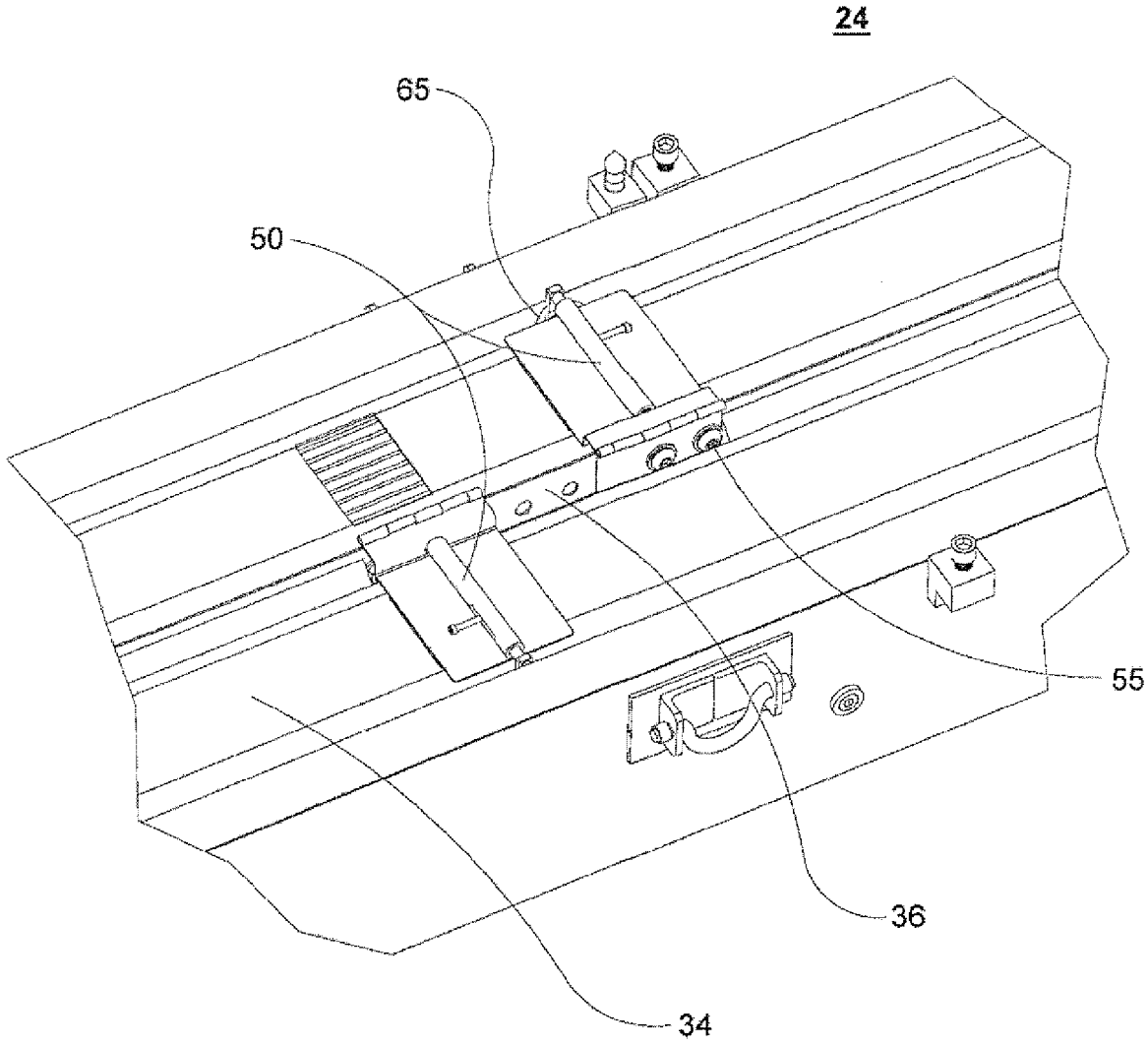
FIG. 11 illustrates the restraining device attached to the borated center rib within the inner shipping container to restrain the channeled fuel assemblies during shipment.

As shown in FIG. 4 and with reference to FIGS. 9-11, at least one hold down bar 50 is attachable across the space or spaces within the inner container 24 that receives the fuel bundle assembly 34. The hold down bars 50 secure the channeled fuel bundles 34 in the inner container 24 by locking the channeled fuel assembly 34 to the inner container 24, which is secured within the outer shipping container 22, of the shipping container 20. Preferably, the hold down bars 50 include a hinged bracket 52 having mounting holes 54 therein for receiving a screw or other fastening mechanism 55 to secure the hold down bar 50 to the center borated rib 36 of the inner container. The hinged bracket 52 is attached to a base plate 56 including a barrel 58 for receiving a spring-loaded plunger 60. An actuator 62 attached to the spring loaded plunger 60 is used to withdraw the spring loaded plunger 60, which is attached with a locking pin 63, from the center rib 36 when locking and/or unlocking the channeled fuel bundle assembly 34 from corresponding apertures 65 within the inner shipping container 24. A locking pin 63 is supported by the spring-loaded plunger 60. A vibration isolation material 64 may be affixed to an underside surface of the base plate 56.

The hold down bars 50 are pivotable via the hinge 52 between a loading position in which the channeled fuel bundle 34 is insertable within the inner container 24 (assuming it is first oriented correctly) and a locking position in which the channeled fuel bundle 34 is locked within the inner shipping container 24. The hold down bars 50 are lockable in the locked position by deflecting the spring-loaded plunger 60 and engaging the locking pin 63 into a corresponding aperture 65 within the inner shipping container 24. The vibration isolation material 64 serves to reduce vibration loads to the channeled fuel assembly 34.

The hold down bars 50 also function as safety devices by restraining the fuel assemblies 34 during package loading and unloading operations at both the factory and the utility sites.

The shipping package may also be provided with memory foam, poly resins or shock absorbing air bags or the like to mitigate shock. These materials could possibly replace existing rigid foams within certain sections of the shipping package 20 or throughout the entire shipping package 20.

With the shipping container described herein, fuel bundles can be shipped in a pre-channeled condition with container structure that prevents arbitrary or independent movement of the bundle components. The container includes structure that additionally reduces vibration during shipping and prevents debris from entering the nuclear fuel assembly.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A shipping container for shipping channeled fuel bundles, the shipping container comprising:

an outer container;

an inner container sized to fit within the outer container; and shock absorbing material disposed between the outer and inner containers, wherein the inner container is shaped to house at least one fuel bundle disposed in a channel and including a channel fastener and an array of rods supported by spacer grids between an upper tie plate and a lower tie plate, and wherein the inner container includes:

a lower tie plate restraint device shaped to receive the lower tie plate and a lower portion of the channel and always engaging all sides of the lower tie plate and the lower portion of the channel when received by the lower tie plate restraint device, the lower tie plate restraint device being lockable into the inner container in only one correct orientation, and an upper tie plate restraint device shaped to receive the upper tie plate and an upper portion of the channel, the upper tie plate restraint device being lockable into the inner container.

2. A shipping container according to claim 1, further comprising a hold down bar attached to the inner container, the hold down bar securing the channeled fuel bundle in the inner container.

3. A shipping container according to claim 2, wherein the hold down bar comprises a hinged bracket attachable to the inner container and a locking member, the hold down bar being pivotable via the hinge between a loading position in which the channeled fuel bundle is insertable in the inner container and a locking position in which the channeled fuel bundle is locked in the inner container, the hold down bar being lockable in the locking position by the locking member.

4. A shipping container according to claim 2, wherein the hold down bar comprises a vibration isolation material on a surface facing the channeled fuel bundle.

5. A shipping container according to claim 2, wherein the locking member comprises a locking pin disposed on an end of a spring-loaded plunger, the locking pin being engageable with an aperture in the inner container.

6. A shipping container according to claim 1, wherein the lower tie plate restraint device comprises protective netting at an end that prevents foreign material from entering the channeled fuel bundle from its bottom.

7. A shipping container according to claim 1, wherein the inner container is sized to receive two channeled fuel bundles with a center rib delineating separate spaces.

8. A shipping container according to claim 7, wherein the center rib is formed of a borated aluminum neutron absorbing material.

9. A shipping container according to claim 7, further comprising a hold down bar for each of the separate spaces attached to the center rib and securable in a locked position across the separate spaces.

10. A shipping container according to claim 1, wherein the lower tie-plate restraint device is sized large enough to include a lower tie-plate Y-block.

11. A shipping container according to claim 1, further comprising at least one of memory foam, poly resins or shock absorbing air bags within the container to mitigate shock.

* * * * *